US005127985A

United States Patent [19]

Ciocca

[11] Patent Number: 5,127,985

[45] Date of Patent: Jul. 7, 1992

[54] PORTABLE DISPENSER APPARATUS

[76] Inventor: Quintino M. Ciocca, 620 Saxonburg Blvd., Pittsburgh, Pa. 15238

[21] Appl. No.: 678,108

[22] Filed: Apr. 1, 1991

[51] Int. Cl.[5] ..... B31F 5/06; B32B 31/18

[52] U.S. Cl. ..... 156/510; 156/554; 225/27; 225/37

[58] Field of Search ..... 225/27, 34, 37, 38, 225/79, 82; 156/510, 554, 511, 516, 527

[56] References Cited

U.S. PATENT DOCUMENTS

| | | | |
|---|---|---|---|
| 3,847,709 | 11/1974 | Martin | 225/34 X |
| 3,912,142 | 10/1975 | Steinhauser et al. | 225/38 X |
| 4,052,248 | 10/1977 | Hunter | 225/38 X |
| 4,470,870 | 9/1984 | Driscoll et al. | 225/38 X |
| 4,525,235 | 6/1985 | Todisco | 225/38 X |
| 4,755,254 | 7/1988 | Bedwell | 225/34 X |
| 4,858,806 | 8/1989 | Schafer | 225/37 X |

*Primary Examiner*—Frank T. Yost
*Assistant Examiner*—Rinaldi Rada
*Attorney, Agent, or Firm*—George C. Atwell

[57] ABSTRACT

A portable apparatus disposed on a level surface for dispensing compactly rolled material such as successively attached sheets or pads, either singly or several at a time for polishing, buffing, abrading, etc., automobiles and other types of vehicles. The apparatus includes an inverted U-shaped frame member having a front portion, an intermediate curved handle portion, and a back bracing portion. A pair of spaced-apart mounting bars are attached to the front portion for rotatably receiving thereon the compactly rolled material. A finger mounting bar is attached to the back bracing portion and has attached, at each end, a pair of pivotally mounted, elongated fingers which are adapted to press down upon and contact the rolled material that is rotatably mounted on the mounting bars. A lower and an upper dispenser box for dispensing individually stacked sheets of pads is secured to one of a pair of spaced-apart triangular-shaped plates that are attached to, and forwardly project from, each end of the finger mounting bar adjacent and inside each respective pair of elongated fingers.

3 Claims, 2 Drawing Sheets

PORTABLE DISPENSER APPARATUS

BACKGROUND OF THE INVENTION

The apparatus of the present invention pertains to upright portable or movable dispensing stands, and more particularly pertains to a portable apparatus for dispensing compactly rolled material such as successively attached sheets or pads used in auto repair and autobody shops.

Auto repair and body shops are stocked with a number of tools and devices for fixing, repairing and renovating automobiles and other types of vehicles. Labor savings devices are also employed to make the repairman's job easier and more efficient. One type of labor saving device is a portable stand for dispensing pads or sheets used in buffing, polishing, sanding, abrading or grinding operations. Normally these items come in thick rolls of successively attached sheets or pads. The rolls are scattered about the workshop on workbenches or shelves, and are used as needed by the workman.

As the workman moves about the vehicle he moves his tools and the rolls of polishing, buffing, finishing or abrading sheets or pads with him. Each sheet or pad must be manually removed as needed by the workman. As work proceeds the rolls become scattered across the garage floor.

In addition, a variety of different types of polishing, buffing, abrading, and finishing sheets or pads may be used on one vehicle. It is inefficient and irksome to continue moving a number of different types of rolls about the vehicle as work progresses. Therefore, a portable apparatus upon which compactly rolled material, such as rolls of sanding, buffing, polishing and abrading sheets or pads, can be mounted will improve the speed and efficiency with which the repair and renovation of automobiles and other vehicles can be accomplished.

SUMMARY OF THE INVENTION

The present invention comprehends a portable apparatus for dispensing compactly rolled material such as successively attached polishing, finishing, buffing, and abrading pads or sheets, either singly or several at a time, for use in auto repair and autobody workshops. The apparatus of the present invention is disposed on a level surface, such as the floor of the autobody or auto repair workshop, and adapted to manual repositioning about the vehicle as work on the vehicle proceeds.

The apparatus of the present invention includes an inverted, U-shaped frame member. The U-shaped frame member is a unitary piece of rigid steel, and is the primary structural component of the apparatus. Further, the U-shaped frame member includes an elongated front portion, an intermediate curved handle portion, and an elongated back bracing portion. The intermediate curved handle portion defines the topmost part of the U-shaped frame member. In addition, the elongated front portion, the intermediate curved handle portion, and the back bracing portion are all located in the same vertical plane.

The apparatus of the present invention includes a pair of spaced apart mounting bars attached to the front portion and projecting transversely thereto. The mounting bars are elongated and cylindrical, and are adapted to receive the compactly rolled material. At least one finger mounting bar is attached to the back bracing portion, and it projects transverse and horizontal to the back bracing portion. The finger mounting bar is located in the same general horizontal plane with at least one mounting bar. Pivotally attached adjacent to each end of the finger mounting bar is an elongated finger. Each elongated finger extends forwardly to the mounting bar and is adapted to press down upon and contact the compactly rolled material when the material is rotatably mounted on the mounting bar. Forwardly projecting or protruding from each end of the finger mounting bar is a triangular-shaped plate. Each triangular-shaped plate is secured to the finger mounting bar at one of the plate corners, and further, is located immediately adjacent and inside each elongated finger.

A spring tensioning means forcefully urges each elongated finger against and in contact with the compactly rolled material when the material is mounted on the mounting bars. The spring tensioning means of the present invention includes four elongated tension springs. A first end of each tension spring is attached to an edge of each triangular-shaped plate at one of the plate corners, and a second end of each spring is attached to each elongated finger, generally at the midpoint of the finger.

It is an object of the present invention to provide a portable or movable apparatus which can be adapted for dispensing various types of compactly rolled material, such as variously-sized wrapping paper used in department stores, fast food shops, or at the deli and meat departments of grocery stores, in addition to its utilization in autobody and repair shops.

It is another objective of the present invention to provide an apparatus which is lightweight, durable and simple to construct and maintain.

Additional objects and features of the invention will become apparent by reference to the drawings, the description and the claims appended thereto.

BRIEF DESCRIPTION OF THE DRAWINGS

1.

DETAILED DESCRIPTION OF THE PREFERRED EMBODIMENT

Figure 1:
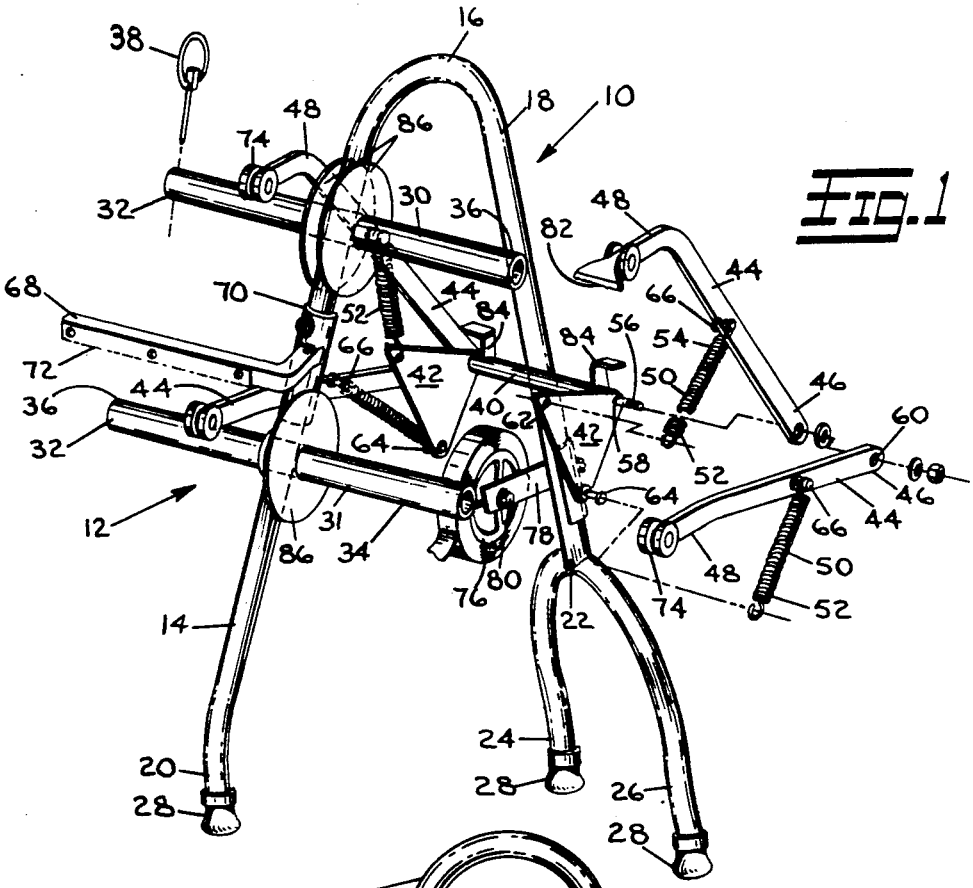
FIG. 1 is a front perspective view of the preferred embodiment of the apparatus of the present invention with elements of the invention shown in exploded view;
2.
Figure 2:
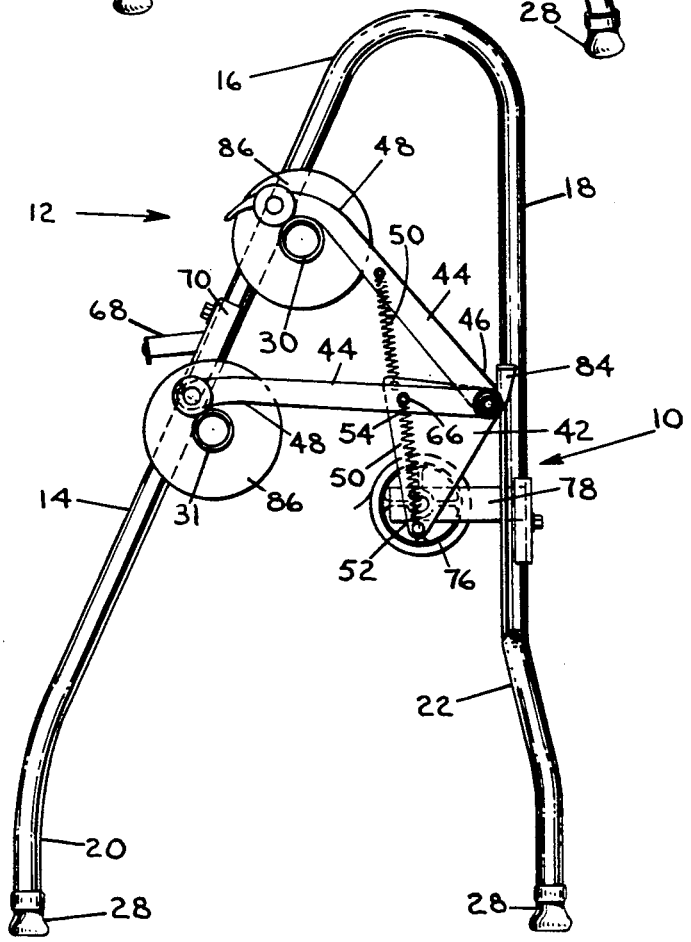
FIG. 2 is a side elevational view of the apparatus first shown in FIG. 1;
3.
Figure 3:
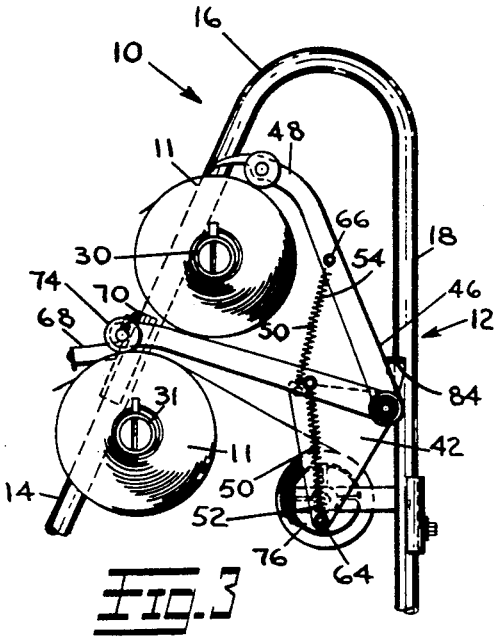
FIG. 3 is an enlarged fragmentary view of the apparatus first shown in FIG. 2;
4.

Referring to the drawings, FIGS. 1, 2 and 3 illustrate a portable or movable apparatus 10 for disposition on a level or floor surface, primarily, though not exclusively, in auto body and auto repair workshops. The apparatus of the present invention is adapted for dispensing compactly rolled material 11, rotatably mounted thereon, the material including successively attached buffing, polishing, sanding, abrading or grinding sheets or pads, either singly or several at a time, for use in renovating and repairing automobiles and other vehicles. The compactly rolled material 11 may also be of the type wherein sheets or pads are adhesively affixed to the material 11, the material 11 serving as a backing and being mounted on the apparatus 10 and unrolled as needed by the workman so that the sheets or pads can be removed from their adhesive fixture to the backing and used on the vehicle.

The main structural component of the apparatus of the present invention is a vertically upright, inverted U-shaped frame member 12. The U-shaped frame member 12 is a unitary piece of bent hollow tubing manufactured from rigid steel. The frame member 12 may also be manufactured out of a firm and durable piece of bent hollow plastic tubing. However, if the frame member 12 is constructed of lightweight steel it would have more durability when disposed in its main work environment of auto body and auto repair workshops. In addition, the apparatus 10 of the present invention can be used to dispense variously gauged conducting wire wrapped around wood or metal spools, the wire utilized in construction and electrical work. Mounting spools of wire on the apparatus 10 will facilitate pulling the wires through a large structure under construction.

The frame member 12 includes a sloping, elongated, upright front portion 14, an intermediate curved handle portion 16, and an upright back bracing portion 18 which is rearwardly spaced from the front portion 14. In the apparatus of the present invention, the three aforementioned structural members comprise the U-shaped frame member 12. However, the front portion 14, the handle portion 16 and the backbracing portion 18 could be constructed from separate pieces of hollow steel tubing or hollow plastic tubing and press fitted together to form the frame member 12, or they could be attached by standard screws or nuts and bolts. This type of construction of the apparatus 10 would be advantageous if it were necessary to break the apparatus 10 down for storage in a confined space.

As illustrated in FIGS. 1, 2 and 3 the handle portion 16 permits the back bracing portion 18 to be spaced from the front portion 14. The front portion 14, the handle portion 16 and the back bracing portion 18 are all located in the same vertically extending plane. When the apparatus 10 must be moved around the worksite, or around the automobile or other vehicle being worked on, the workman can manually grasp the handle portion 16 and, because the frame member 12 is lightweight in construction, the apparatus 10 can be easily moved about the vehicle.

As illustrated in FIGS. 1 and 2, the front portion 14 terminates at a lower front member foot 20. The lower front member foot 20 rests upon the level surface when the apparatus 10 is disposed in its operative position. However, as is evident from FIGS. 1 and 2, the back bracing portion 18 does not extend to the level surface as the front portion 14 does. The back bracing portion 18 is approximately two thirds the length of the front portion 14, and attached to the back bracing portion 18 is an inverted U-shaped floor support member 22, with each respective end of prongs 24 and 26 of the floor support member 22 resting upon the level surface when the apparatus 10 is disposed in its operative position. The floor support member 22 projects downwardly from the back bracing portion 18 and towards the level or floor surface. In addition, the floor support member 22 extends in a generally vertically extending plane that is perpendicular to the vertically extending plane of the frame member 12. As shown in FIGS. 1 and 2, the lower front member foot 20 and the end of each prong 24 and 26 of the floor support member 22 have attached thereto a rubber stopper 28. Each rubber stopper 28 prevents the floor surface from being scratched or marred if the apparatus 10 is dragged across it instead of being manually lifted by gripping the handle portion 16. Also, wheels can be fixed to the foot 20 and end of each prong 24 and 26.

At least one horizontally-extending mounting bar may be attached to the front portion 14. As illustrated in FIGS. 1 and 2 the apparatus of the present invention includes two horizontally-extending mounting bars, respectively an upper mounting bar 30 and a lower mounting bar 31, that are spaced from each other and are attached to the front portion 14. More specifically, the pair of mounting bars 30 and 31 project transversely and horizontally in relation to the front portion 14. Each mounting bar 30 and 31 terminates at a first distal end 32 and an oppositely disposed second distal end 34 and is constructed out of a hollow cylindrical elongated piece of steel tubing that is secured at its midpoint to the front portion 14. Located adjacent the first distal end 32 and the second distal end 34 of each mounting bar 30 and 31 are a pair of axially aligned oppositely disposed pinholes 36. At least a pair of retaining pins, and in he apparatus of the present invention, a total of four retaining pins 38, are adapted for removable insertion through each pair of pinholes 36. The purpose of the retaining pins 38 will be more fully described hereinafter. Each mounting bar 30 and 31 is adapted for allowing the removable insertion or placement thereon of the compactly rolled material 11. The compactly rolled material 11 is normally wrapped around a hollow tube, usually made of cardboard or plastic, and, the hollow tube with the material 11 wrapped tightly therearound, is removably mounted on the mounting bar 30 and 31 at either the first distal end 32 or the second distal end 34.

Attached to the back bracing portion 18, as shown in FIGS. 1, 2 and 3, is at least one horizontally extending finger mounting bar 40. The finger mounting bar 40 is secured to the back bracing portion 18 and projects transversely on either side of the back bracing portion 18. Furthermore, the finger mounting bar 40 is generally located in the same horizontally extending plane with at least one of the mounting bars 30 and 31; in the present invention, the finger mounting bar 40 is located in the same horizontal plane as the lower mounting bar 31. The length and thickness of the finger mounting bar 40 is slightly less than that of the mounting bars 30 and 31. In the apparatus of the present invention the finger mounting bar 40 is secured to the back bracing portion 18 approximately one third of the way up the back bracing portion 18.

At least one flat, vertically extending, triangular-shaped plate is necessary for the proper operation of the apparatus of the present invention. As illustrated in FIG. 1, the apparatus 10 includes a pair of spaced apart, triangular-shaped plates 42, one plate 42 secured at each end of the finger mounting bar 40, the securement further occuring at one of a plurality of plate corners, and adjacent the edge of each triangular shaped plate 42. Each triangular plate 42 of the apparatus of the present invention projects forwardly toward the front portion 14 and the mounting bars 30 and 31. Also, each triangular-shaped plate 42 is made from a thin piece of rigid steel. The purpose of each plate 42 shall be shortly described hereinafter.

At least one elongated finger should be attached to the finger mounting bar 40. As shown in FIG. 1, the apparatus 10 of the present invention includes four pivotally attached elongated fingers 44, each finger 44 being pivotally attached at the end of the finger mounting bar 40 and immediately adjacent and outside of each respective triangular-shaped plate 42. More specifically, each elongated finger 44 is pivotally attached adjacent the end of the finger mounting bar 40 at a first finger end 46, and a second finger end 48 is located immediately adjacent and, as illustrated in FIG. 3, partially in contact with the compactly rolled material 11 when the material 11 is inserted on either or both of the mounting bars 30 and 31, and each elongated finger 44 is adapted to press down upon and contact the compactly rolled material 11. The elongated fingers 44 may be constructed out of firm, durable plastic or shaped and formed steel; in the apparatus of the present invention, the elongated fingers 44 are manufactured from steel. As illustrated in FIGS. 2 and 3, the second finger end 48 has a slight curvature, the curvature being greater for the fingers 44 that are associated with the upper mounting bar 30. Such curvature allows these respective elongated fingers 44 to conform to the cylindrical shape of the compactly rolled material 11 as illustrated in FIG. 3.

In order to prevent the material 11 from completely unrolling as it is being dispensed by the workmen, the elongated fingers 44 must be forcefully urged against and pressed down upon the material 11 when mounted on the mounting bars 30 and 31. A spring tensioning means is utilized to effect the forceful urging of each finger 44 at the second finger end 48 down upon and in contact with the material 11 when the material 11 is rotatably mounted on either or both mounting bars 30 and 31.

In the apparatus 10 of the present invention, as illustrated in FIGS. 1 through 3, the spring tensioning means includes a plurality of elongated tension springs 50. The apparatus of the present invention includes four elongated tension springs 50, one tension spring 50 adapted for each finger 44, respectively. As illustrated in FIGS. 1, 2 and 3, each tension spring 50 has a first end 52 attached at an edge of each of the triangular-shaped plates 42 adjacent to one of the plate corners. Each elongated tension spring 50 also has a second end 54 which is attached to each of the fingers 44. The second end 54 of which elongated tension spring 50 is attached generally at the midpoint of each elongated finger 44.

As illustrated in FIG. 1, the attachment of each triangular-shaped plate 42 to each end of the finger mounting bar 40, and the pivotal attachment of the fingers 44 also to each end of the finger mounting bar 40, and the consequent attachment of the elongated tension springs 50 is accomplished in a simple and efficient manner.

Both ends of the finger mounting bar 40 terminate at a rigid rod 56. Each triangular-shaped plate 42 has a plate hole 58 adjacent one of the plate corners whereupon each triangular plate 42 is inserted on the rod 56 and then secured thereto so that at least one edge of the triangular plate 42 is generally horizontal and parallel with respect to the floor surface. Each finger 44 has a finger mounting hole 60 adjacent its first finger end 46, and the rod 56 of the finger mounting bar 40 projects through each finger mounting hole 60.

More specifically, as shown in FIG. 1, in the preferred embodiment of the apparatus 10 of the present invention, the upper mounting bar 30 and a lower mounting bar 31 have two fingers 44 working in tandem with each respective mounting bar 30 and 31. In assembling the apparatus 10 of the present invention, the two fingers 44 that are adapted for the upper mounting bar 30 are attached to each respective rod 56, and then the two fingers 44 that are adapted for the lower mounting bar 31 are attached to the each respective opposite rod 56. A standard washer and nut attached to the end of each rod 56 secures each pair of fingers 44 to the finger mounting bar 40.

Thus, as illustrated in FIG. 1, in the preferred embodiment of the apparatus 10 of the present invention, two fingers 44 are pivotally attached to each end of the finger mounting bar 40 in the aforedescribed manner. The two fingers 44 which may be described as being on the inside are adapted for the upper mounting bar 30 while what may be described as the fingers 44 adjacent and on the outside are adapted for the lower mounting bar 31. The manner in which each tension spring 50 is attached will next be described.

As illustrated in FIGS. 1 and 2, each triangular plate 42 includes a plate hole 62 located adjacent to the most forwardly projecting plate corner, and, laterally projecting from each triangular plate 42, and located adjacent the plate corner projecting downwardly toward the floor surface, is a spring attachment screw 64. Each screw 64 transversely protrudes from each respective plate 42. In addition, each finger 44 on the outside has a finger attachment screw 66 mounted at approximately the midpoint of its length and projecting horizontally and laterally therefrom. Each finger 44 on the inside includes one finger attachment screw 66 which projects laterally and inwardly from each respectively inside finger 44. Finally, the tension springs 50 include hooked ends, as illustrated in FIG. 1.

After the fingers 44 on he inside and the fingers 44 on the outside are attached to the finger mounting bar 40, each elongated tension spring 50 can be then attached. Each tension spring 50 on each outer finger 44 will have one of its hooked ends attached to the finger attachment screw 66 and the other hooked end attached to the spring screw 64 laterally projecting from that respective triangular plate 42. The tension springs 50 that are adapted for each inner elongated finger 44 will have one of their hooked ends attached to the finger attachment screw 66 that projects horizontally and inwardly from each inside finger 44, and the other hooked end will be inserted through each plate hole 62 of each triangular plate 42. Thus, the fingers 44 will be restricted with regard to their pivotal movement away from each mounting bar 30 and 31 and the material 11 when the material 11 is rotatably mounted upon either or both the upper mounting bar 30 and the lower mounting bar 31.

Moreover, when the material 11, as shown in FIG. 3, is mounted upon the upper and/or lower mounting bars 30 and 31, the tension springs 50 will forcefully urge each respective finger 44 upon the material 11. As sheets or pads are selectively dispensed therefrom, the fingers 44 press down upon the compactly rolled material 11 due to the tension of springs 50, thus preventing the unwanted rolling of the material 11.

As illustrated in FIGS. 1 through 3, the apparatus of the present invention also includes an L-shaped tear bar 68 which is attached to the front portion 14 in between the upper mounting bar 30 and the lower mounting bar 31. The tear bar 68 projects outwardly from its securement to the front portion 14, and, more specifically, the tear bar 68 is integrally formed at one end from a cylindrical elongated sleeve 70. The elongated sleeve 70 is mounted to the front portion 14, thus securing the tear bar 68 in position. Furthermore, the tear bar 68 is located adjacent to the material 11 that would be mounted upon either the upper mounting bar 30 or the lower mounting bar 31. When the workman requires a length of the material 11, he grasps the loose end of the material 11 and pulls it toward himself until he has the length required. Then he severs the length of material 11 by pulling it against a serrated tear bar edge 72 attached to the tear bar 68. This forceful pulling against the tear bar edge 72 severs the desired length or portion thereof from the material 11 mounted on the mounting bar 30 and 31. Otherwise, the workman would have to take the time to cut each length of material as it was required.

As illustrated in FIG. 1, 2 and 3, several other structural features have been added to the apparatus of the present invention in order to facilitate the quick and efficient removal of the material 11 or sheets or pads affixed to the material 11. One feature is an oppositely disposed, adjacent disk-shaped finger rollers rotatably mounted at the second finger end 48 of at least one finger 44. As shown in FIG. 1 and 3, the apparatus 10 of the present invention includes four fingers 44, and all of the elongated fingers 44 include a pair of disk-shaped finger rollers 74 rotatably mounted at each respective second finger end 48 for contacting the material 11 when mounted on the mounting bars 30 and 31. Instead of the material 11 being unrolled against the resistive surface of each second finger end 48, the finger rollers 74 facilitate the generally non-resistive unrolling of the material 11. The rotation of the material 11 as a free end or loose end of the material 11 is being pulled therefrom causes the generally non-resistive rotation of the finger rollers 74 against the material 11. Thus, the material 11 can be easily unrolled when it is mounted on the mounting bars 30 and 31.

While working on a vehicle adhesive or masking tape may be required in order to secure covering strips or a portion of the material 11 serving as a protective covering to areas of the vehicle that do not need paint or to cover and protect portions of the vehicle while adjacent areas of the vehicle are being polished, abraded, buffed, etc. The apparatus of the present invention, as illustrated in FIGS. 1, 2 and 3, includes a tape dispenser wheel 76 for quickly and efficiently dispensing strips of masking or adhesive tape. A dispenser bar 78 is secured to the back bracing portion 18 beneath the finger mounting bar 40 and projects forwardly toward the front portion 14. Secured to the end of the dispenser bar 78, and laterally projecting therefrom, is a wheel spindle 80. The tape dispenser wheel 76 is mounted on the wheel spindle 80 and secured thereto be a standard nut and washer. The masking or adhesive tape is then simply mounted upon the tape dispenser wheel 76 with the inner circumferential surface of the masking or adhesive tape in contiguous contact with the annular outer surface of the tape dispenser wheel 76. To accommodate adhesive or masking tape that has varying diameters for its inner circumferential surface, tape dispenser wheels of varying diameters can easily be made for mounting upon the wheel spindle 80.

In addition, as illustrated in FIG. 3, adhesive tape can be affixed to the material 11, and as the material 11 is unrolled and dispensed the adhesive tape unrolls in tandem with the material 11. This avoids the difficulty of holding a covering strip, for example, on a portion of the vehicle with one hand, and attempting to affix with the other free hand, a length of adhesive tape to the vehicle and the covering strip.

As shown in FIG. 1, in the apparatus of the present invention the upper mounting bar 30 is spaced from the lower mounting bar 31. Each transversely projecting portion of the upper mounting bar 30 and the lower mounting bar 31 is adapted to have rotatably mounted thereon the rolled material 11, and the apparatus of the present invention can accommodate four rolls of material 11, two mounted on the upper mounting bar 30 and two on the lower mounting bar 31, respectively. The tear bar 68 accommodates the roller material 11 that is mounted on the left portion of the upper mounting bar 30 and the lower mounting bar 31 if one were standing directly in front of the apparatus 10.

In addition, as illustrated in FIGS. 1 and 2, a serrated tear off claw 82 is included on the inside elongated finger 44 located at the left side of the apparatus 10 viewed frontally. Instead of this finger 44 terminating with one of the finger rollers 74, this elongated finger 44 terminates at the second finger end 48 with the triangular-shaped serrated tearoff claw 82. The serrated edge of the tear off claw 82 permits the workman to sever the desired length of the material 11 without manually cutting the material 11. Although the preferred embodiment of the apparatus 10 shows only one tear-off claw 82, each finger 44 could have a tear-off claw 82 included at each respective second finger end 48.

As shown in FIGS. 1, 2 and 3, a pair of oppositely disposed pivot finger retains 84 are secured to the finger mounting bar 40. More specifically, each respective pivot retainer 84 is attached at each end of the finger mounting bar 40 adjacent and inside of each respective triangular-shaped plate 42. In the apparatus 10 of the present invention the pivot retains 84 are an L-shaped piece of bent metal which is secured (preferably by welding) to each respective end of the finger mounting bar 40 and protrudes upwardly therefrom. At the point wherein each first finger end 46 of both the fingers 44 on the inside and the fingers 44 on the outside are pivotally attached to the finger mounting bar 40, a portion of each respective pivot retainer 84 hooks or curves partially around and over each first finger end 46 of each of the fingers 44. Each pivot retainer 84 restricts the pivoting movement of the fingers 44 in the direction backward or away from the mounting bars 30 and 31. This feature prevents the workman from pulling the fingers 44 backward to a point where each respective tension spring 50 is pulled out of shape and damaged.

In addition, if a workman were to suddenly release each finger 44 after he has pulled it away from the mounting bars 30 and 31 after removal of the rolled material 11, the distance that respective finger 44 would travel until it struck the respective mounting bar 30 and 31 would be limited in part because each pivot retainer 84 restricts the distance away from each mounting bar 30 and 31 that the fingers 44 can be pulled.

Another structural feature which enhances the apparatus 10 of the present invention, and is illustrated in FIGS. 1 and 2, is at least a pair of oppositely disposed intermediate disks mounted on either or both mounting bars 30 and 31. The apparatus of the present invention includes a total of four intermediate disks 86, and in FIG. 1 three intermediate disks 86 are shown, with a pair of intermediate disks 86 mounted on the upper mounting bar 30 adjacent the front portion 14 and to the inside of the respective fingers 44, and an intermediate disk 86 is shown mounted on the lower mounting bar 31 also adjacent to the front portion 14 and positioned inside that respective finger 44. The intermediate disks 86 may be permanently secured to the mounting bars 30 and 31 or the disks 86 may be adapted for removable placement thereupon each respective mounting bar 30 and 31. When the rolled material 11 is placed on each mounting bar 30 and 31, each respective retaining pin 38 prevents the lateral movement of the material 11 off of that respective mounting bar 30 or 31 when a portion or length of the material 11 is being unrolled or dispensed therefrom. Each disk 86 also prevents the lateral inward movement of the material 11, when a portion or length of the material 11 is being unrolled or dispensed from contacting and rubbing against the front portion 14 thus impeding its smooth unrolling.

Figure 5:
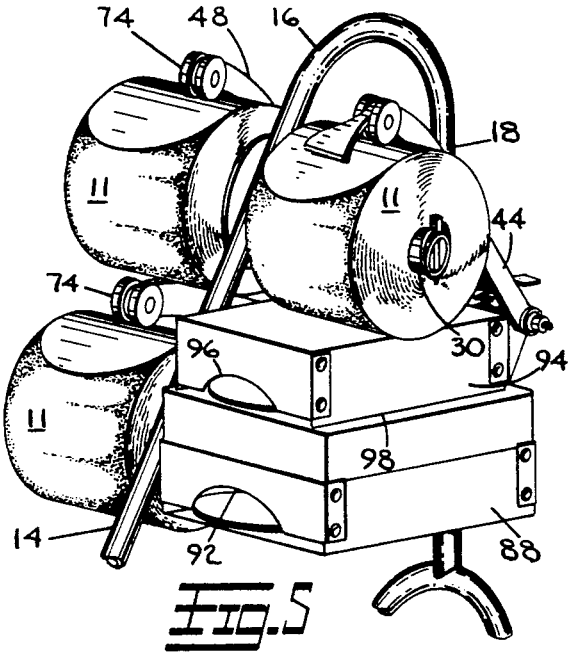
FIG. 5 is an enlarged fragmentary view from a front perspective of the apparatus first shown in FIG. 4.
Figure 4:
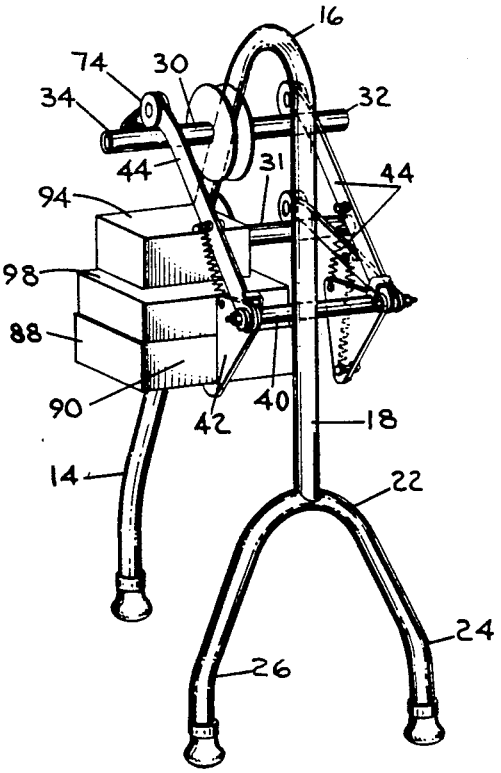
FIG. 4 is a rear perspective view of an alternate embodiment of the apparatus of the present invention first shown in FIG. 1; and
5.

FIGS. 4 and 5 illustrate an alternate preferred embodiment of the apparatus of the present invention. In the alternate preferred embodiment of the apparatus of the present invention, all of the structural elements and features heretofore described with reference to FIGS. 1, 2 and 3 are included. However, as shown in FIGS. 4 and 5, the alternate preferred embodiment of the apparatus includes several structural features not shown or included in the preferred embodiment of the apparatus of the present invention. Instead of the lower mounting bar 31 projecting transverse on both sides of the front portion 14, one portion of the lower mounting bar 31 is removed. In the alternate preferred embodiment of the apparatus of the present invention, the portion of the lower mounting bar 31 that is removed is the right hand portion if one were standing directly in front of the apparatus 10. In its place, a generally square-shaped lower dispenser box 88 is secured and mounted to that respective triangular-shaped plate 42.

More specifically, the lower dispenser box 88 is secured to a forwardly facing edge of that respective triangular-shaped plate 42, and the triangular-shaped plate 42 has a smaller size as illustrated in FIG. 4, than the other oppositely attached triangular-shaped plate 42. The lower dispenser box 88 is secured to that respective triangular-shaped plate 42 at its rear wall 90, and the dispenser box 88 extends forwardly and adjacent to the front portion 14. The lower dispenser box 88 also includes a crescent-shaped, front opening slot 92 through which individually stacked sheets or pads of the compactly rolled material 11 can be removed or inserted, after they have first been lifted or taken off the material 11.

Thus, with this alternate embodiment the workman has the option of rotatably mounting the material 11 upon the upper mounting bar 30 and/or the lower left half or portion of the lower mounting bar 31, and selectively unrolling and dispensing the desired length of the material 11 or sheets or pads adhesively affixed to the material 11. In addition, sheets or pads can be individually stacked inside the lower dispenser box 88 and removed therefrom as needed.

Moreover, a generally square-shaped upper dispenser box 94 is located superjacent to the lower dispenser box 88. The upper dispenser box 94 is smaller in size than the lower dispenser box 88 (although the box 94 can be the same size of slightly larger than the lower box 88), and the upper dispenser box 94 also includes a crescent-shaped upper opening slot 96 through which sheets or pads can be inserted and removed after they have been first removed from the rolled material 11. The lower dispenser box 88 is also characterized by a flat, horizontally extending top plate 98 which further defines and serves as a floor for the upper dispenser box 94.

While there has been described and illustrated a preferred embodiment and an alternate preferred embodiment of the apparatus of the present invention, it is apparent that numerous alternations, variations and additions may be made without departing from the spirit thereof.

I claim:

1. A movable apparatus for disposition on a level surface for dispensing rolled material, the apparatus comprising:

an upright, inverted U-shaped frame member, the frame member characterized by an elongated, upright front portion, an intermediate curved handle portion attached to the front portion, and an elongated, upright back bracing portion attached to the intermediate curved handle portion and rearwardly spaced from the front portion, the inverted U-shaped frame member further characterized by the front portion the curved handle portion and the back bracing portion all located within a vertically extending plane;

at least one horizontally extending mounting bar, the bar attached to the upright front portion and projecting transversely and horizontally from the upright front portion and adapted for having the rolled material rotatably mounted thereon;

a horizontally extending finger mounting bar attached to the back bracing portion, the finger mounting bar projecting transversely from the back bracing portion;

at least one elongated finger pivotally attached to the finger mounting bar, the finger adapted to forcefully press down upon and contact the rolled material when the material is rotatably mounted on the mounting bar;

a spring tensioning means for forcefully urging the finger against the rolled material when the material is rotatably mounted on the mounting bar;

a pair of spaced-apart, flat, vertically extending, triangular-shaped, plates with each plate secured to an end of the finger mounting bar and projecting forwardly toward the front portion;

a lower dispenser box secured to a forwardly facing edge of one of the triangular-shaped plates and extending forwardly and adjacent to the upright front portion, the lower dispenser box characterized by a crescent-shaped, front opening slot through which individually stacked material can be removed or inserted;

an upper dispenser box located superjacent to the lower dispenser box, the upper dispenser box smaller in size than the lower dispenser box and having a crescent-shaped upper opening slot for allowing removal or insertion of material; and the lower dispenser box also characterized by a flat, horizontally extending top plate, the top plate further serving as a floor for the upper dispenser box.

2. The apparatus of claim 1 wherein at least one elongated finger includes a tear-off claw which is characterized by a serrated edge that is adapted to sever the material by manually pulling the material against the serrated edge.

3. The apparatus of claim 1 further comprising a pair of oppositely-disposed intermediate disks mounted on the mounting bar adjacent the front portion and separated from each other by the front portion, the intermediate disks adapted to prevent the lateral movement of the rolled material from contacting the front portion when the material is being unrolled and dispensed therefrom.

* * * * *